US006211762B1

(12) United States Patent
Kikui et al.

(10) Patent No.: US 6,211,762 B1
(45) **Date of Patent: *Apr. 3, 2001**

(54) CORROSION-RESISTANT PERMANENT MAGNET AND METHOD FOR MANUFACTURING THE SAME

(75) Inventors: Fumiaki Kikui, Minamikawachi-gun; Masako Ikegami, Amagasaki; Koshi Yoshimura, Ibaraki, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/242,825

(22) PCT Filed: Jul. 25, 1997

(86) PCT No.: PCT/JP97/02579

§ 371 Date: Feb. 24, 1999

§ 102(e) Date: Feb. 24, 1999

(87) PCT Pub. No.: WO98/09300

PCT Pub. Date: Mar. 5, 1998

(30) Foreign Application Priority Data

| | | |
|---|---|---|
| Aug. 30, 1996 | (JP) | 8-249209 |
| Sep. 9, 1996 | (JP) | 8-261482 |
| Sep. 26, 1996 | (JP) | 8-277200 |

(51) Int. Cl.[7] ..... H01F 7/02

(52) U.S. Cl. ..... 335/302; 428/651

(58) Field of Search ..... 335/302–308; 428/11, 27, 552, 632, 651, 90

(56) References Cited

U.S. PATENT DOCUMENTS

| | | | | |
|---|---|---|---|---|
| 5,082,745 | * | 1/1992 | Ohashi | 428/552 |
| 5,167,914 | * | 12/1992 | Fujimura et al. | 419/11 |
| 5,275,891 | * | 1/1994 | Tagaya et al. | 428/632 |
| 5,316,595 | * | 5/1994 | Hamada et al. | 148/302 |
| 6,080,498 | | 6/2000 | Kikui et al. . | |

* cited by examiner

*Primary Examiner*—Lincoln Donovan
(74) *Attorney, Agent, or Firm*—Dykema Gossett PLLC

(57) ABSTRACT

An R—Fe—B permanent magnet body is cleaned by ion sputtering, after which a Ti coating film is formed on the surface of the magnet body by a thin film forming method such as ion plating, after which an Al coating film is formed as an intermediate layer, after which an AlN coating film, TiN coating film, or $Ti_{1-x}Al_xN$ coating film is formed by a thin film forming method such as ion reactive plating in $N_2$ gas. By having the Al coating film layer present as an intermediate layer, it acts as a sacrificial coating film for the permanent magnet body and the foundation layer Ti coating film, whereupon adhesion with the Ti coating film is sharply improved, and the time until corrosion develops is lengthened, even in such severe corrosion resistance tests as salt water spray tests. Thus R—Fe—B permanent magnets are obtained which exhibit outstanding salt water spray resistance and wear resistance and which have stable magnetic characteristics.

13 Claims, No Drawings

CORROSION-RESISTANT PERMANENT MAGNET AND METHOD FOR MANUFACTURING THE SAME

FIELD OF THE INVENTION

This invention relates to an R—Fe—B permanent magnet provided with an anticorrosive coating, exhibiting high magnetic characteristics, outstanding resistance to salt water spray, acid resistance, alkaline resistance, wear resistance, and adhesion, and relates more particularly to an anticorrosive permanent magnet, and fabrication method therefor, which has extremely stable magnetic characteristics that exhibit little deterioration from the initial magnetic characteristics, while exhibiting outstanding resistance to salt water spray.

BACKGROUND ART

R—Fe—B permanent magnets have already been proposed (in Japanese Patent Laid-open No. S59-46008/1984, in gazette, and Japanese Patent Laid-open No. S59-89401/1984, in gazette) which have B and Fe as their main components, using light rare earth elements such as Nd and Pr which are plentiful resources, which contain no high-cost Sm or Co, and which offer new high-performance permanent magnets that greatly exceed the maximum performance of conventional rare earth cobalt magnets.

The magnet alloys noted above have a Curie temperature ranging generally from 300° C. to 370° C. By replacing some of the Fe with Co, however, an R—Fe—B permanent magnet is obtained having a higher Curie temperature (Japanese Patent Laid-open No. S59-64733/1984, Japanese Patent Laid-open No. S59-132104/1984). Also proposed (in Japanese Patent Laid-open No. S60-34005/1985) is a Co-containing R—Fe—B rare earth permanent magnet that exhibits a Curie temperature that is at least as high as the Co-containing R—Fe—B rare earth permanent magnet noted above, and a higher (BH)max, wherein, in order to enhance the temperature characteristics, and especially to improve the iHc, at least one heavy rare earth element such as Dy or Th is contained in some of the R in the Co-containing R—Fe—B rare earth permanent magnet wherein such light rare earth elements as Nd and Pr are primarily used as the rare earth element (R), whereby, while maintaining an extremely high (BH)max of 25 MGOe or greater, iHc is raised higher.

There are problems, however, in that the permanent magnets noted above, which are made from R—Fe—B magnetic anisotropic sintered bodies exhibiting outstanding magnetic properties, have as their main component an active chemical compound composition containing rare earth elements and iron, wherefore, when they are built into a magnetic circuit, due to oxides that are produced on the surface of the magnets, magnetic circuit output decline and variation between magnetic circuits are induced, and peripheral equipment is contaminated by the separation of the oxides from the magnet surfaces.

Thereupon, a permanent magnet has been proposed (in Japanese Patent Publication No. H3-74012/1991) wherein the surface of the magnet body is coated with an anticorrosive metal plating layer, by either an electrolytic or non-electrolytic plating method, in order to improve the anticorrosion performance of the R—Fe—B magnets noted above. With these plating methods, however, the permanent magnet body is a porous sintered body, wherefore, in a pre-plating process, acidic solution or alkaline solution remains in the pores, giving rise to fears of degradation over time and corrosion, and the chemical resistance of the magnet body deteriorates, wherefore the magnet surface is corroded during plating so that adhesion and anticorrosion performance are impaired.

Even when an anticorrosive plating layer is provided, in anticorrosion tests in which samples are exposed to a temperature of 60° C. and relative humidity of 90% for 100 hours, the magnetic characteristics proved to be very unstable, exhibiting 10% or greater degradation from the initial magnetic characteristics.

For this reason, it has been proposed (in Japanese Patent Publication No. H5-15043/1993) that, in order to improve the anticorrosion performance of R—Fe—B permanent magnets, an ion plating method or ion sputtering method or the like be used to coat the surfaces of the magnets noted above with AlN, Al, TiN, or Ti. However, the AlN and TiN coatings have crystalline structures, coefficients of thermal expansion, and ductilities that differ from those of the R—Fe—B magnet bodies, wherefore adhesion is poor and, although the adhesion and anticorrosive properties of the Al and Ti coatings are good, their anti-wear performance is poor.

In order to resolve these problems, it has been proposed (in Japanese Patent Laid-open No. S63-9919/1988, in gazette) that the surface of the R—Fe—B permanent magnet bodies be coated with laminated Ti and TiN films. However, the crystalline structure, coefficient of thermal expansion, and ductility of the Ti and TiN coating films differ, so adhesion is poor, peeling occurs, and anticorrosion performance declines.

For these reasons, the inventors, for outstanding anticorrosive permanent magnets exhibiting outstanding adhesion with the foundation, proposed (in Japanese Patent Laid-open No. H6-349619/1994) an anticorrosive permanent magnet wherein, after forming a Ti coating film having a specific film thickness as the foundation film on the surface of an R—Fe—B permanent magnet body, by a thin film forming method, an N diffusion layer wherein the N concentration increases as the surface is approached is formed in the specific film thickness of the surface of the Ti coating film, by a thin film forming method, while introducing a gas mixture of Ar gas and $N_2$ gas under specific conditions, after which a TiN coating film of a specific film thickness is coated on, in $N_2$ gas, by a thin film forming method such as ion plating, and (in Japanese Patent Laid-open No. H7-249509/1995) an anticorrosive permanent magnet having an Al coating film of a specific film thickness as the foundation film.

However, while the anticorrosive permanent magnets noted above exhibited outstanding anticorrosiveness in anticorrosion tests at a temperature of 80° C. and relative humidity of 90%, in severe anticorrosion tests such as salt water spray tests (spray tests with 5% neutral NaCl solution under JIS Z2371 test conditions at 34° C. to 36° C.), the anticorrosive performance was inadequate. Thus magnets are needed which will be resistive to salt water spray and exhibit adequate anticorrosiveness even in salt water spray tests, for use, for example, in undulators exposed to the atmosphere.

DISCLOSURE OF THE INVENTION

An object of the present invention is to provide an R—Fe—B permanent magnet, together with a fabrication method therefor, that exhibits outstanding adhesion with the R—Fe—B permanent magnet foundation, anti-wear properties, and stably high magnetic characteristics, together with extremely little deterioration from the initial magnetic characteristics even in such severe anticorrosion tests as salt water spray tests (JIS Z2371) using 5% neutral NaCl solution in a temperature range of 34~36° C., anti-wear properties, and resistance to salt water spray.

The inventors conducted various investigations on methods of forming AlN coating films, TiN coating films, or $Ti_{1-x}Al_xN$ coating films on permanent magnet surfaces, for the purpose of realizing an R—Fe—B permanent magnet exhibiting stable magnetic characteristics, because of the anti-wear properties and resistance to salt water spray of an applied anticorrosive coating film exhibiting outstanding adhesion with the foundation, and wherewith the time until corrosion occurs when subjected to salt water spray of 5% neutral NaCl solution in a temperature range of 34~36° C. can be lengthened. As a result, they discovered that, when the foundation coating film is only the Ti coating layer or the Al coating layer noted earlier, whereas the electric potential of the R—Fe—B magnet overall is "superior," portions exist locally inside the magnet, where Nd is present, etc., which are very "inferior," wherefore corrosion readily occurs through very small pin holes in the AlN coating film, or the TiN coating film, or the $Ti_{1-x}Al_xN$ coating film.

Thereupon, the inventors conducted further investigations on methods of forming AIN coating films, TiN coating films, and $Ti_{1-x}Al_xN$ coating films. As a result, they discovered that by first providing a Ti coating film layer on the surface of the permanent magnet, and then providing an Al coating film layer, as a foundation for the AlN coating film, or TiN coating film, or $Ti_{1-x}Al_xN$ coating film, the Al coating film layer acts as a sacrificial coating film for the Ti coating film layer, because of the fact that Al is electrochemically slightly "inferior" to Ti, whereupon, even if corrosion occurs from very small pinholes in the AlN coating film, or TiN coating film, or $Ti_{1-x}Al_xN$ coating film in the surface layer, it does not immediately penetrate the foundation film as far as the base material of the magnet body, and, so long as the Al coating film is present as an intermediate layer between the Ti coating film in the foundation layer and either the AlN coating film, or TiN coating film, or $Ti_{1-x}Al_xN$ coating film, the R—Fe—B permanent magnet body that is coated by the Ti coating film in the foundation layer is protected.

The inventors discovered two more things that led to the perfection of the present invention. Firstly, they discovered that by generating an AlN coating film on the Al coating film, AlNx is produced at the interface between the Al and AlN, making it possible to sharply improve the adhesion between the Al coating film and AlN coating film. Secondly, they discovered that by forming either a TiN coating film or a $Ti_{1-x}Al_xN$ coating film on the Al coating film, a complex coating film of Ti, Al, and N constituting $Ti_{1-\alpha}Al_\alpha N_\beta$ (where $0<\alpha<1$ and $0<\beta<1$) is produced, the composition and film thickness whereof vary, depending on the substrate temperature, bias voltage, film formation speed, and $Ti_{1-x}Al_xN$ composition, etc., so that, as a consequence, $AlN_x$ is produced at the interface between the Al coating film and either the TiN coating film or the $Ti_{1-x}Al_xN$ coating film, and the adhesion between the Al and AlN coating films can be sharply improved.

More specifically, the present invention is a permanent magnet, and fabrication method therefor, which is resistant to salt water spray, wherein a Ti coating film having a film thickness of 0.1 to 3.0 $\mu$m is formed, by a thin film forming method, on the cleaned surface of an R—Fe—B permanent magnet, the main phase whereof is a tetragonal lattice phase, after which an Al coating film having a film thickness of 0.1 to 5 $\mu$m is formed on the Ti coating film, and an AlN coating film, TiN coating film, or $Ti_{1-x}Al_xN$ coating film (where $0.03<x<0.70$) is formed at a film thickness of 0.5 to 10 $\mu$m on the Al coating film.

BEST MODE FOR CARRYING OUT THE INVENTION

A detailed description is now given of an example, in the present invention, of a method of fabricating a permanent magnet resistant to salt water spray, characterized in that a Ti coating film layer is formed by a thin film forming method on the cleaned surface of an R—Fe—B permanent magnet body the main phase whereof is a tetragonal lattice phase, after which an AlN coating film layer is provided, via an Al coating film layer formed on the Ti coating film layer.

1) Using an arc ion plating apparatus, for example, after evacuating a vacuum vessel to an attained degree of vacuum of $1\times10^{-3}$ Pa or below, the surface of the R—Fe—B magnet body is cleaned by surface sputtering with Ar ions at an Ar gas pressure of 10 Pa and −500 V. Next, with the Ar gas pressure at 0.1 Pa and the bias voltage at −80 V, the target Ti is evaporated, and a Ti coating film layer having a film thickness of 0.1 to 3.0 $\mu$m is formed on the surface of the magnet body by arc ion plating.

2) Next, with the Ar gas pressure at 0.1 Pa and the bias voltage at −50 V, the target Al is evaporated and an Al coating film having a film thickness of 1 to 5 $\mu$m is formed by arc ion plating.

3) Then, using Al as the target, under conditions wherein the substrate magnet temperature is held at 250° C., an $N_2$ gas pressure of 1 Pa, and a bias voltage of −100 V, an AlN coating film layer of a specific thickness is formed on the Al coating film layer.

Next is given a detailed description of an example of a method of fabricating a permanent magnet resistant to salt water spray, characterized in that, after forming a Ti coating film layer on the surface of the R—Fe—B permanent magnet, a TiN coating film layer is provided via an Al coating film layer formed on the Ti coating film layer.

1) Using an arc ion plating apparatus, for example, after evacuating a vacuum vessel to an attained degree of vacuum of $1\times10^{-3}$ Pa or below, the surface of the R—Fe—B magnet body is cleaned by surface sputtering with Ar ions at an Ar gas pressure of 10 Pa and −500 V.

Next, with the Ar gas pressure at 0.1 Pa and the bias voltage at −80 V, the target Ti is evaporated, and a Ti coating film layer having a film thickness of 0.1 to 3.0 μm is formed on the surface of the magnet body by arc ion plating.

2) Next, with the Ar gas pressure at 0.1 Pa and the bias voltage at −50 V, the target Al is evaporated and an Al coating film having a film thickness of 1 to 5 μm is formed by arc ion plating.

3) Then, using Ti as the target, under conditions wherein the substrate magnet temperature is held at 250° C., an $N_2$ gas pressure of 1 Pa, a bias voltage of −100 V, and arc current of 100 A, a TiN coating film layer of a specific thickness is formed on the Al coating film layer.

Next is given a detailed description of an example of a method of fabricating a permanent magnet resistant to salt water spray, characterized in that, after forming a Ti coating film layer on the surface of the R—Fe—B permanent magnet, a $Ti_{1-x}Al_xN$ (where 0.03<x<0.70) coating film layer is formed via an Al coating film layer formed on the Ti coating film layer.

1) Using an arc ion plating apparatus, for example, after evacuating a vacuum vessel to an attained degree of vacuum of $1\times10^{-3}$ Pa or below, the surface of the R—Fe—B magnet body is cleaned by surface sputtering with Ar ions at an Ar gas pressure of 10 Pa and −500 V.

Next, with the Ar gas pressure at 0.1 Pa and the bias voltage at −80 V, the target Ti is evaporated, and a Ti coating film layer having a film thickness of 0.1 to 3.0 μm is formed on the surface of the magnet body by arc ion plating.

2) Next, with the Ar gas pressure at 0.1 Pa and the bias voltage at −50 V, the target Al is evaporated and an Al coating film having a film thickness of 1 to 5 μm is formed by arc ion plating.

3) Then, using $Ti_{1-x}Al_xN$ (where 0.03<x<0.70) as the target, under conditions wherein the substrate magnet temperature is held at 250° C., an $N_2$ gas pressure of 3 Pa, and a bias voltage of −120 V, a $Ti_{1-x}Al_xN$ (where 0.03<x<0.70) coating film layer of a specific thickness is formed on the Al coating film layer.

In the present invention, in terms of the method of forming a Ti coating film layer, Al coating film layer, AlN coating film layer, or TiN coating film layer, or, alternatively, a $Ti_{1-x}Al_xN$ coating film layer that adheres to the surface of the R—Fe—B permanent magnet body, a known thin film forming method such as ion plating or vapor deposition may be suitably selected. However, for reasons of coating film fineness, uniformity, and coating formation speed, etc., the ion plating and ion reaction plating methods are preferable.

It is desirable that the temperature of the substrate magnet be set between 200° C. and 500° C. during coating formation. At temperatures below 200° C., the reaction adhesion with the substrate magnet is inadequate, while at temperatures exceeding 500° C., the temperature difference with room temperature (+25° C.) becomes great, fine cracks develop in the coatings during post-process cooling, and partial peeling away from the substrate occurs. Hence the substrate magnet temperature is set in the 200° C.~500° C. range.

In the present invention, the reason for limiting the thickness of the Ti coating film on the surface of the magnet body to the range of 0.1~3.0 μm is that adhesion with the magnet surface is inadequate at thicknesses below 0.1 μm, while at thicknesses in excess of 3.0 μm, although there is no problem in terms of effectiveness, the cost of the foundation layer rises, becoming both impractical and undesirable. Thus the Ti coating film thickness is made 0.1 μm to 3.0 μm.

In the present invention, moreover, the reason for limiting the thickness of the Al coating film formed on the surface of the Ti coating film to the range of 0.1~5 μm is that, at thicknesses below 0.1 μm, it is hard for Al to adhere uniformly to the surface of the Ti coating film, and the effectiveness as an intermediate layer film is inadequate, whereas at thicknesses in excess of 5 μm, although there is no problem in terms of effectiveness, the cost of the intermediate layer film becomes large, which is undesirable. Thus the Al coating film thickness is made 0.1 μm to 5 μm.

The reason for limiting the thickness of the AlN coating film, tin coating film, or $Ti_{1-x}Al_xN$ (where 0.03<x<0.70) to the range of 0.5~10 μm is that, at thicknesses below 0.5 μm, the resistance to salt water spray and the wear resistance of the AlN coating film, or TiN coating film, or $Ti_{1-x}Al_xN$ coating film are inadequate, whereas at thicknesses in excess of 10 μm, although there is no problem in terms of effectiveness, the fabrication cost is increased, which is undesirable.

The reason for limiting the value of x in the $Ti_{1-x}Al_xN$ coating film is that, when that value is below 0.03, the performance desired in the $Ti_{1-x}Al_xN$ coating film (resistance to salt water spray, wear resistance) is not elicited, whereas at values exceeding 0.70, no enhancement in performance is realized.

The rare earth element R used in the permanent magnet in the present invention accounts for 10 atomic % to 30 atomic % of the composition, but it is desirable that this contain either at least one element from among Nd, Pr, Dy, Ho, and Tb, or, in addition thereto, at least one element from among La, Ce, Sm, Gd, Er, Eu, Tm, Yb, Lu, and Y. Ordinarily, it is sufficient to have one of the R elements, but in practice, it is possible to use a mixture of two or more elements (misch metal, didymium, etc.) for reason of ease of procurement. This R need not be a pure rare earth element either; there is no problem with it containing impurities as may be unavoidable in manufacture, with a range as can be procured industrially.

R is a mandatory element in the permanent magnets noted above. At lower than 10 atomic %, the crystalline structure becomes a cubic crystal system having the same structure as a-iron, wherefore high magnetic characteristics, especially high coercive force, are not obtained. When 30 atomic % is exceeded, the R-rich nonmagnetic phase increases and residual magnetic flux density (Br) declines, wherefore a permanent magnet exhibiting outstanding characteristics is not obtained. Thus the range of 10~30 atomic % for R is desirable.

B is a mandatory element in the permanent magnets noted above. At lower than 2 atomic %, a rhombohedral structure becomes the main phase, and high coercive force (iHc) is not obtained. When 28 atomic % is exceeded, the B-rich nonmagnetic phase increases and residual magnetic flux density (Br) declines, so that outstanding permanent magnets are not obtained. Thus the range of 2~28 atomic % is desirable for B.

Fe is a mandatory element in the permanent magnets noted above. Below 65 atomic %, the residual magnetic flux density (Br) declines. When 80 atomic % is exceeded, high coercive force is not obtained. Thus a range of 65~80 atomic % is desirable for Fe. By replacing some of the Fe with Co, the temperature characteristics can be improved without impairing the magnetic characteristics of the magnets obtained. When the amount of Co replacement exceeds 20% of the Fe, on the other hand, the magnetic characteristics deteriorate, so that is undesirable. When the amount of Co replacement is 5 to 15 atomic % of the total quantity of Fe and Co, Br increases as compared to when there is no substitution, and high magnetic flux density is realized, which is desirable.

In addition to the R, B, and Fe elements, the presence of such impurities as is unavoidable in the course of industrial production is allowable. By substituting at least one element out of C, P, S, and Cu for some of the B, namely C at 4.0 wt % or less, P at 2.0 wt % or less, S at 2.0 wt % or less, and/or Cu at 2.0 wt % or less, for example, such that the total amount of the substitution is 2.0 wt % or less, it is possible to improve permanent magnet productivity and reduce costs.

It is also possible to add at least one element out of Al, Ti, V, Cr, Mn, Bi, Nb, Ta, Mo, W, Sb, Ge, Sn, Zr, Ni, Si, Zn, and HF, to the R—Fe—B permanent magnet material in order to improve coercive force or the rectangularity of the demagnetization curve, or to reduce costs. As to the upper limit of the quantity of such additives, Br must be at least 9 kG or greater in order to get (BH)max of the magnetic material above 20 MGOe, so it should be within a range wherein this condition can be satisfied.

The permanent magnets of the present invention are characterized in that the main phase is made a compound having a tetragonal crystalline structure wherein the mean crystal grain diameter is within a range of 1~80 $\mu$m, containing a non-magnetic phase (excluding oxide phase) within a volume ratio of 1~50%.

The permanent magnets according to the present invention exhibit coercive force iHc≧1 kOe, residual magnetic flux density Br>4 kG, and maximum energy product (BH) max≧10 MGOe, with a maximum value of 25 MGOe or higher.

EMBODIMENTS

Embodiment 1

A commonly known cast ingot was crushed and finely pulverized, and then subjected to molding, sintering, and heating processes to yield a magnet body test piece having the composition 14Nd—0.5Dy—7B—78.5Fe, with a diameter of 12 mm and a thickness of 2 mm. The magnetic characteristics thereof are noted in Table 1.

A vacuum vessel was vacuum evacuated to $1\times10^{-3}$ or below, surface sputtering was conducted for 20 minutes in an Ar gas pressure of 10 Pa, at −500 V, and the surface of the magnet body was cleaned. Then, with the substrate magnet temperature at 280° C., Ar gas pressure at 0.1 Pa, and bias voltage at −80 V, a target of metallic Ti was subjected to arc ion plating to form a Ti coating film layer of thickness 1 $\mu$m on the magnet body surface.

Then, with the substrate magnet temperature at 250° C., Ar gas pressure at 0.1 Pa, and bias voltage at −50 V, an Al coating film layer of thickness 2 $\mu$m was formed on the surface of the Ti coating film by arc ion plating, using metallic Al as the target.

Next, with the substrate magnet temperature at 350° C., the bias voltage at −100 V, and $N_2$ gas pressure at 1 Pa, an AlN coating film layer having a film thickness of 2 $\mu$m was formed on the surface of the Al coating film, subjecting a target of metallic Al to arc ion plating for 2 hours.

Then, after cooling, the permanent magnet obtained with the AlN coating film on its surface was subjected to salt water spray testing (JIS Z2371) with 5% neutral NaCl at a temperature of 35° C., and the time until corrosion ensued was measured. The results are noted together with the magnetic characteristics in Table 2.

Comparison 1

Using a magnet body test piece having the same composition as the first embodiment, a Ti coating film layer of 3 $\mu$m was formed on the magnet body test piece, under the same conditions as for the first embodiment, after which an AlN coating film layer was formed to the same film thickness (2 $\mu$m) and under the same conditions as for the first embodiment, after which salt water spray tests were conducted, under the same conditions as for the first embodiment, and the time until corrosion ensued was measured. The results are noted together with the magnetic characteristics in Table 2.

Comparison 2

Using a magnet body test piece having the same composition as the first embodiment, an Al coating film layer of 3 $\mu$m was formed on the surface of the magnet body, under the same conditions as for the first embodiment, after which, under the same conditions as for the first embodiment, an AlN coating film layer of the same film thickness was formed, after which salt water spray tests were conducted, under the same conditions as for the first embodiment, and the time until corrosion ensued was measured. The results are noted together with the magnetic characteristics in Table 2.

Embodiment 2

A commonly known cast ingot was crushed and finely pulverized, and then subjected to molding, sintering, and heating processes to yield a magnet body test piece having the composition 15Nd—77Fe—8B, with a diameter of 12 mm and a thickness of 2 mm. The magnetic characteristics thereof are noted in Table 3.

A vacuum vessel was vacuum evacuated to $1\times10^{-3}$ or below, surface sputtering was conducted for 20 minutes in an Ar gas pressure of 10 Pa, at −500 V, and the surface of the magnet body was cleaned. Then, with the substrate magnet temperature at 280° C., Ar gas pressure at 0.1 Pa, bias voltage at −80 V, and arc current at 100 A, a target of metallic Ti was subjected to arc ion plating to form a Ti coating film layer of thickness 1 $\mu$m on the magnet body surface.

Then, with the substrate magnet temperature at 250° C., Ar gas pressure at 0.1 Pa, bias voltage at −50 V, and arc current at 50 A, an Al coating film layer of thickness 2 $\mu$m was formed on the surface of the Ti coating film by arc ion plating, using metallic Al as the target.

Next, with the substrate magnet temperature at 350° C., the bias voltage at −100 V, the arc current at 100 A, and $N_2$ gas pressure at 1 Pa, a TiN coating film layer having a film thickness of 2 μm was formed on the surface of the Al coating film, subjecting a target of metallic Ti to arc ion plating for 2 hours.

Then, after cooling, the permanent magnet obtained with the TiN coating film on its surface was subjected to salt water spray testing (JIS Z2371) with 5% neutral NaCl at a temperature of 35° C., and the time until corrosion ensued was measured. The results are noted together with the magnetic characteristics in Table 4.

Comparison 3

Using a magnet body test piece having the same composition as the second embodiment, a Ti coating film layer of 3 μm was formed on the magnet body test piece, under the same conditions as for the second embodiment, after which a TiN coating film layer was formed to the same film thickness (2 μm) and under the same conditions as for the second embodiment, after which salt water spray tests were conducted, under the same conditions as for the second embodiment, and the time until corrosion ensued was measured. The results are noted together with the magnetic characteristics in Table 4.

Comparison 4

Using a magnet body test piece having the same composition as the first embodiment, an Al coating film layer of 3 μm was formed on the surface of the magnet body, under the same conditions as for the first embodiment, after which, under the same conditions as for the second embodiment, a TiN coating film layer of the same film thickness was formed, after which salt water spray tests were conducted, under the same conditions as for the second embodiment, and the time until corrosion ensued was measured. The results are noted together with the magnetic characteristics in Table 4.

Embodiment 3

A commonly known cast ingot was crushed and finely pulverized, and then subjected to molding, sintering, and heating processes to yield a magnet body test piece having the composition 15Nd—1Dy—76Fe—8B, with a diameter of 12 mm and a thickness of 2 mm. The magnetic characteristics thereof are noted in Table 1.

A vacuum vessel was vacuum evacuated to $1\times10^{-3}$ or below, surface sputtering was conducted for 20 minutes in an Ar gas pressure of 10 Pa, at −500 V, and the surface of the magnet body was cleaned. Then, with the substrate magnet temperature at 280° C., Ar gas pressure at 0.1 Pa, and bias voltage at −80 V, a target of metallic Ti was subjected to arc ion plating to form a Ti coating film layer of thickness 1 μm on the magnet body surface.

Then, with the substrate magnet temperature at 250° C., Ar gas pressure at 0.1 Pa, and bias voltage at −50 V, an Al coating film layer of thickness 2 μm was formed on the surface of the Ti coating film by arc ion plating, using metallic Al as the target. Next, with the substrate magnet temperature at 350° C., the bias voltage at −100 V, and $N_2$ gas pressure at 1 Pa, a $Ti_{1-x}Al_xN$ coating film layer having a film thickness of 2 μm was formed on the surface of the Al coating film, subjecting a target of $Ti_{0.45}Al_{0.55}$ alloy to arc ion plating for 2 hours. The composition of the coating film produced was $Ti_{0.45}Al_{0.55}N$.

Then, after cooling, the permanent magnet obtained with the TiN coating film on its surface was subjected to salt water spray testing (JIS Z2371) with 5% neutral NaCl at a temperature of 35° C., and the time until corrosion ensued was measured. The results are noted together with the magnetic characteristics in Table 5.

Comparison 5

Using a magnet body test piece having the same composition as the third embodiment, a Ti coating film layer of 3 μm was formed on the magnet body test piece, under the same conditions as for the first embodiment, after which a $Ti_{0.5}Al_{0.5}N$ coating film layer was formed to the same film thickness (2 μm) and under the same conditions as for the first embodiment, after which salt water spray tests were conducted, under the same conditions as for the third embodiment, and the time until corrosion ensued was measured. The results are noted together with the magnetic characteristics in Table 6.

Comparison 6

Using a magnet body test piece having the same composition as the third embodiment, an Al coating film layer of 3 μm was formed on the surface of the magnet body, under the same conditions as for the first embodiment, after which, under the same conditions as for the first embodiment, a $Ti_{0.5}Al_{0.5}N$ coating film layer of the same film thickness was formed, after which salt water spray tests were conducted, under the same conditions as for the third embodiment, and the time until corrosion ensued was measured. The results are noted together with the magnetic characteristics in Table 6.

TABLE 1

| | Magnetic Characteristics Prior to Salt Water Spray Resistance Test | | | | | |
|---|---|---|---|---|---|---|
| | After Aging Treatment | | | After Surface Treatment | | |
| | Br(kG) | iHc (kOe) | (BH)max (MGOe) | Br(kG) | iHc (kOe) | (BH)max (MGOe) |
| Embodiment 1 | 11.2 | 15.2 | 30.1 | 11.1 | 15.1 | 30.0 |
| Comparison 1 | 11.3 | 15.3 | 30.2 | 11.3 | 15.2 | 30.1 |
| Comparison 2 | 11.2 | 15.3 | 30.1 | 11.2 | 15.2 | 30.0 |

TABLE 2

| | Salt Water Spray Test Time Until Corrosion Ensues (hr) | Magnetic Characteristics: 50 Hours After Salt Water Spray Test Br (kG) | iHc (kOe) | (BH) max (MGOe) | Magnetic Characteristic Degradation Ratio (%) Br (kG) | iHc (kOe) | (BH) max (MGOe) |
|---|---|---|---|---|---|---|---|
| Embodiment 1 | 50 hr | 11.1 | 14.9 | 29.9 | <1 | 2.0 | <1 |
| Comparison 1 | 5 hr | 9.3 | 10.9 | 25.3 | 17.7 | 28.8 | 16.2 |
| Comparison 2 | 15 hr | 10.1 | 13.3 | 26.6 | 10.8 | 13.1 | 11.6 |

$$\text{Magnetic Characteristic Degradation Ratio (\%)} = \frac{(\text{Magnetic Characteristics After Salt Water Spray Resistance Test}) - (\text{Magnetic Characteristics After Aging})}{(\text{Magnetic Characteristics After Aging})}$$

TABLE 3

| | Magnetic Characteristics Prior to Salt Water Spray Resistance Test: After Aging Treatment Br(kG) | iHc (kOe) | (BH)max (MGOe) | After Surface Treatment Br(kG) | iHc (kOe) | (BH)max (MGOe) |
|---|---|---|---|---|---|---|
| Embodiment 2 | 11.2 | 17.3 | 30.5 | 11.1 | 17.3 | 30.5 |
| Comparison 3 | 11.3 | 17.4 | 30.5 | 11.3 | 17.5 | 30.5 |
| Comparison 4 | 11.2 | 17.3 | 30.5 | 11.2 | 17.2 | 30.5 |

TABLE 4

| | Salt Water Spray Test Time Until Corrosion Ensues (hr) | Magnetic Characteristics: 50 Hours After Salt Water Spray Test Br (kG) | iHc (kOe) | (BH) max (MGOe) | Magnetic Characteristic Degradation Ratio (%) Br (kG) | iHc (kOe) | (BH) max (MGOe) |
|---|---|---|---|---|---|---|---|
| Embodiment 2 | 50 hr | 11.1 | 17.1 | 30.1 | <1 | 1.2 | <1 |
| Comparison 3 | 10 hr | 9.7 | 13.4 | 25.6 | 14.2 | 23.0 | 16.1 |
| Comparison 4 | 15 hr | 10.1 | 14.8 | 27.6 | 9.8 | 14.5 | 9.5 |

$$\text{Magnetic Characteristic Degradation Ratio (\%)} = \frac{(\text{Magnetic Characteristics After Salt Water Spray Resistance Test}) - (\text{Magnetic Characteristics After Aging})}{(\text{Magnetic Characteristics After Aging})}$$

TABLE 5

| | Magnetic Characteristics Prior to Salt Water Spray Resistance Test: After Aging Treatment Br(kG) | iHc (kOe) | (BH)max (MGOe) | After Surface Treatment Br(kG) | iHc (kOe) | (BH)max (MGOe) |
|---|---|---|---|---|---|---|
| Embodiment 3 | 11.2 | 16.0 | 30.0 | 11.1 | 16.0 | 30.0 |
| Comparison 5 | 11.3 | 16.1 | 30.1 | 11.3 | 16.0 | 30.0 |
| Comparison 6 | 11.2 | 16.0 | 30.0 | 11.2 | 16.0 | 30.0 |

TABLE 6

| | Salt Water Spray Test Time Until Corrosion Ensues (hr) | Magnetic Characteristics: 50 Hours After Salt Water Spray Test Br (kG) | iHc (kOe) | (BH) max (MGOe) | Magnetic Characteristic Degradation Ratio (%) Br (kG) | iHc (kOe) | (BH) max (MGOe) |
|---|---|---|---|---|---|---|---|
| Embodiment 3 | 50 hr | 11.1 | 15.9 | 29.9 | <1 | <1 | <1 |
| Comparison 5 | 10 hr | 9.8 | 13.4 | 25.8 | 13.3 | 16.1 | 14.3 |
| Comparison 6 | 20 hr | 10.3 | 14.6 | 27.8 | 8.0 | 9.4 | 7.3 |

$$\text{Magnetic Characteristic Degradation Ratio (\%)} = \frac{(\text{Magnetic Characteristics After Salt Water Spray Resistance Test}) - (\text{Magnetic Characteristics After Aging})}{(\text{Magnetic Characteristics After Aging})}$$

What is claimed is:

1. A permanent magnet made of an R—Fe—B system alloy resistant to salt water corrosion with a layer consisting of Ti as an undercoat coated on a surface layer of said magnet, either a TiN layer, an AlN layer or a $Ti_{1-x}Al_xN$ layer (where x:0.03–0.70) as an external layer, and an Al layer inserted as an intermediate layer between the Ti undercoat layer and the external layer.

2. The permanent magnet according to claim 1, wherein the Ti undercoat layer has a thickness of 0.1 μm to 3.0 μm.

3. The permanent magnet according to claim 1, wherein the external layer consists of TiN and has a thickness of 0.5 μm to 10 μm.

4. The permanent magnet according to claim 1, wherein the external layer consists of AlN and has a thickness of 0.5 μm to 10 μm.

5. The permanent magnet for ultra-high vacuum according to claim 1, wherein the external layer consists of $Ti_{1-x}AlN$ (where x:0.03–0.70) and has a thickness of 0.5 μm to 10 μm.

6. The permanent magnet for ultra-high vacuum according to claim 1, wherein the Al intermediate layer has a thickness of 0.5 μm to 5.0 μm.

7. A production process for a permanent magnet resistant to salt water corrosion, comprising the sequential steps of:

cleaning a surface layer of an R—Fe—B system magnet whose main phase consists of a tetragonal phase;

forming an undercoat layer consisting of Ti on the cleaned surface of valid R—Fe—B system magnet using a thin film forming method;

forming an Al layer on the Ti undercoat layer using a thin film forming method; and forming either one of a TiN layer, an AlN layer or a $Ti_{1-x}Al_xN$ (where x is 0.03 to 0.70) layer as an external layer using a thin film forming method.

8. The production process for the permanent magnet according to claim 7, wherein said thin film forming method is either an ion plating or an evaporation method.

9. The production process for the permanent magnet according to claim 7, wherein the Ti undercoat layer is formed to a thickness between 0.1 μm and 3.0 μm.

10. The production process for the permanent magnet according to claim 7, wherein the external layer is formed of TIN to a thickness of 0.5 μm to 10 μm.

11. The production process for the permanent magnet according to claim 7, wherein the external layer is formed of AlN to a thickness of 0.5 μm to 10 μm.

12. The production process for the permanent magnet according to claim 7, wherein the external layer is formed of $Ti_{1-x}Al_xN$ (where x:0.03–0.70) to a thickness of 0.5 μm to 10 μm.

13. The production process for the permanent magnet according to claim 7, wherein the intermediate Al layer is formed to a thickness of 0.1 μm to 5 μm.

* * * * *